US009925644B2

(12) United States Patent
Yamahara

(10) Patent No.: US 9,925,644 B2
(45) Date of Patent: Mar. 27, 2018

(54) ADAPTER

(71) Applicant: 3M INNOVATIVE PROPERTIES COMPANY, St. Paul, MN (US)

(72) Inventor: Michihiro Yamahara, Kanagawa (JP)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 0 days.

(21) Appl. No.: 14/895,077

(22) PCT Filed: Jun. 11, 2014

(86) PCT No.: PCT/US2014/041861
§ 371 (c)(1),
(2) Date: Dec. 1, 2015

(87) PCT Pub. No.: WO2014/201087
PCT Pub. Date: Dec. 18, 2014

(65) Prior Publication Data

US 2016/0129557 A1 May 12, 2016

(30) Foreign Application Priority Data

Jun. 14, 2013 (JP) ..... 2013-125682

(51) Int. Cl.
*B24D 5/16* (2006.01)
*B24B 45/00* (2006.01)

(52) U.S. Cl.
CPC ..... *B24D 5/16* (2013.01); *B24B 45/00* (2013.01)

(58) Field of Classification Search
CPC ..... B24D 7/16; B24D 5/16; B24D 13/20
USPC ..... 451/360, 359, 342, 541, 508
See application file for complete search history.

(56) References Cited

U.S. PATENT DOCUMENTS 1,584,835 A * 5/1926 Blanch ..... B24B 45/00 451/342
1,788,634 A * 1/1931 Robinson ..... B24D 5/16 451/342
RE24,143 E 4/1956 Leggett
4,240,230 A * 12/1980 Ferrantini ..... B24D 7/16 451/342
4,878,316 A 11/1989 MacKay, Jr.
5,306,319 A 4/1994 Krishnan
6,116,996 A * 9/2000 Yanase ..... B24B 23/02 451/359

(Continued)

FOREIGN PATENT DOCUMENTS

EP 2 363 241 9/2011
JP 7-144104 6/1995

(Continued)

*Primary Examiner* — Monica Carter
*Assistant Examiner* — Lauren Beronja

(57) ABSTRACT

An adapter according to one aspect is an adapter for fixing to a shaft of a grinding machine a grinding wheel having a through-hole where the shaft is inserted. The adapter is provided with a main body having at least a portion thereof inserted into the through-hole, the main body including an outer wall that contacts a wall of the through-hole and an inner wall that forms an opening that corresponds to the shaft, and a plurality of reinforcing parts provided in predetermined intervals along a circumferential direction of the main body. Each reinforcing part extends from the inner wall to the outer wall, and a notch is formed in each reinforcing part.

20 Claims, 14 Drawing Sheets

(56) References Cited

U.S. PATENT DOCUMENTS

| | | | | |
|---|---|---|---|---|
| 6,490,750 | B2 * | 12/2002 | Shia | A46B 13/001 15/179 |
| 7,144,315 | B1 | 12/2006 | Sun | |
| 2012/0190279 | A1 * | 7/2012 | Ficai | B24D 5/10 451/442 |

FOREIGN PATENT DOCUMENTS

| | | | |
|---|---|---|---|
| JP | 07185942 | A * | 7/1995 |
| JP | H10-34543 | | 2/1998 |
| JP | 11-099460 | | 4/1999 |
| JP | 2000-190217 | | 7/2000 |
| JP | 2005-329518 | | 12/2005 |
| WO | WO 2000-38883 | | 7/2000 |
| WO | 2001/014100 | | 3/2001 |

* cited by examiner

ADAPTER

CROSS REFERENCE TO RELATED APPLICATIONS

This application is a national stage filing under 35 U.S.C. 371 of PCT/US2014/041861, filed Jun. 11, 2014, which claims priority to Japanese Patent Application No. 2013-125682, filed Jun. 14, 2013, the disclosures of which are incorporated by reference in their entirety herein.

BACKGROUND

Grinding wheels for grinding metal members and the like are conventionally known. In Patent Document 1 given below, for example, a description is given of a grinding wheel in which a through-hole with a shaft inserted therein is formed. The grinding wheel described in the below Patent Document 1 grinds a metal member or the like by rotating the grinding wheel using the shaft.

Patent Document 1: Specification of U.S. Reissued Pat. No. 24,143

SUMMARY OF THE INVENTION

The above Patent Document 1 describes fitting the grinding wheel directly to the shaft, but if there is a significant difference in size between the shaft diameter and the grinding wheel inner diameter, it becomes difficult to assemble and match both parts.

The adapter according to one aspect of the present invention is an adapter for fixing to a shaft of a grinding machine a grinding wheel having a through-hole where the shaft is inserted. The adapter is provided with a main body having at least a portion thereof inserted into the through-hole, the main body including an outer wall that contacts a wall of the through-hole and an inner wall that forms an opening that corresponds to the shaft, and a plurality of reinforcing parts provided in predetermined intervals along a circumferential direction of the main body. Each reinforcing part extends from the inner wall to the outer wall, and a notch is formed in each reinforcing part.

Use of this type of adapter enables a gap to be easily adjusted even if a gap exists between the grinding wheel inner diameter and the shaft diameter. In other words, changing to a different size adapter allows the grinding wheel to easily attach to the shaft even if a gap exists between the grinding wheel inner diameter and the shaft diameter.

Further, because a notch is formed in the reinforcing part, the reinforcing part flexes when the adapter is inserted into the through-hole of the grinding wheel and generates a restoring force after insertion such that the reinforcing part tries to return to its original form. Because a constant pressure is applied toward the wall of the through-hole from the outer wall of the adapter by the restoring force, the adapter is securely fixed inside the grinding wheel. Therefore, if the adapter is appropriately fixed to the shaft, the grinding wheel can ultimately be securely fixed to the shaft.

Effect of the Invention

According to one aspect of the present invention, adjusting a gap between the grinding wheel inner diameter and the shaft diameter enables the grinding wheel to be appropriately fixed to the shaft.

DETAILED DESCRIPTION

Figure 1:
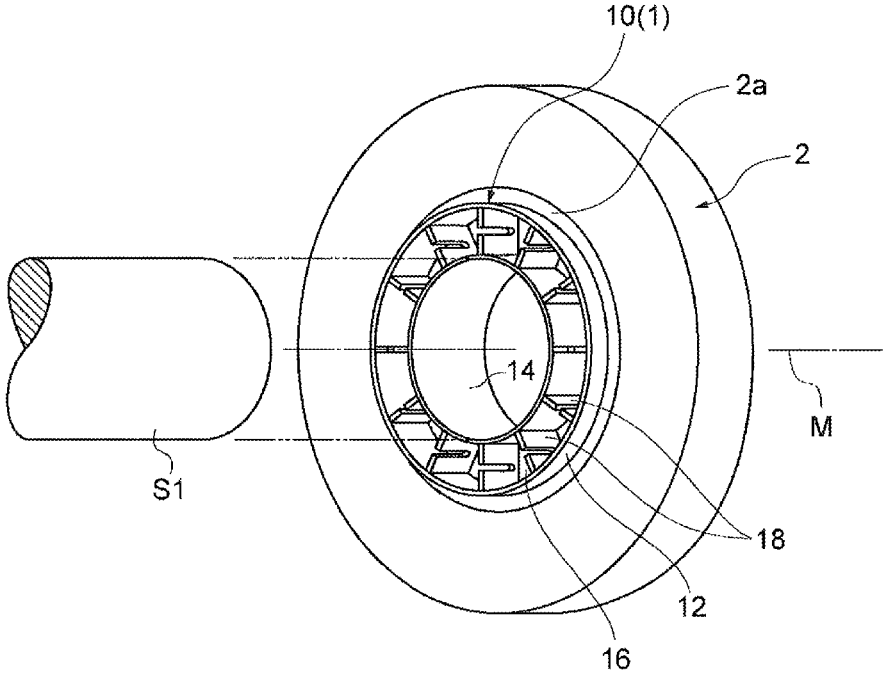
FIG. 1 is a diagram illustrating an adapter according to an embodiment inserted into a grinding wheel.

Embodiments of the present invention are described below with reference to the attached drawings. In the following explanation, the same or corresponding elements are given the same reference numeral, and duplicate explanations are omitted.

Figure 2:
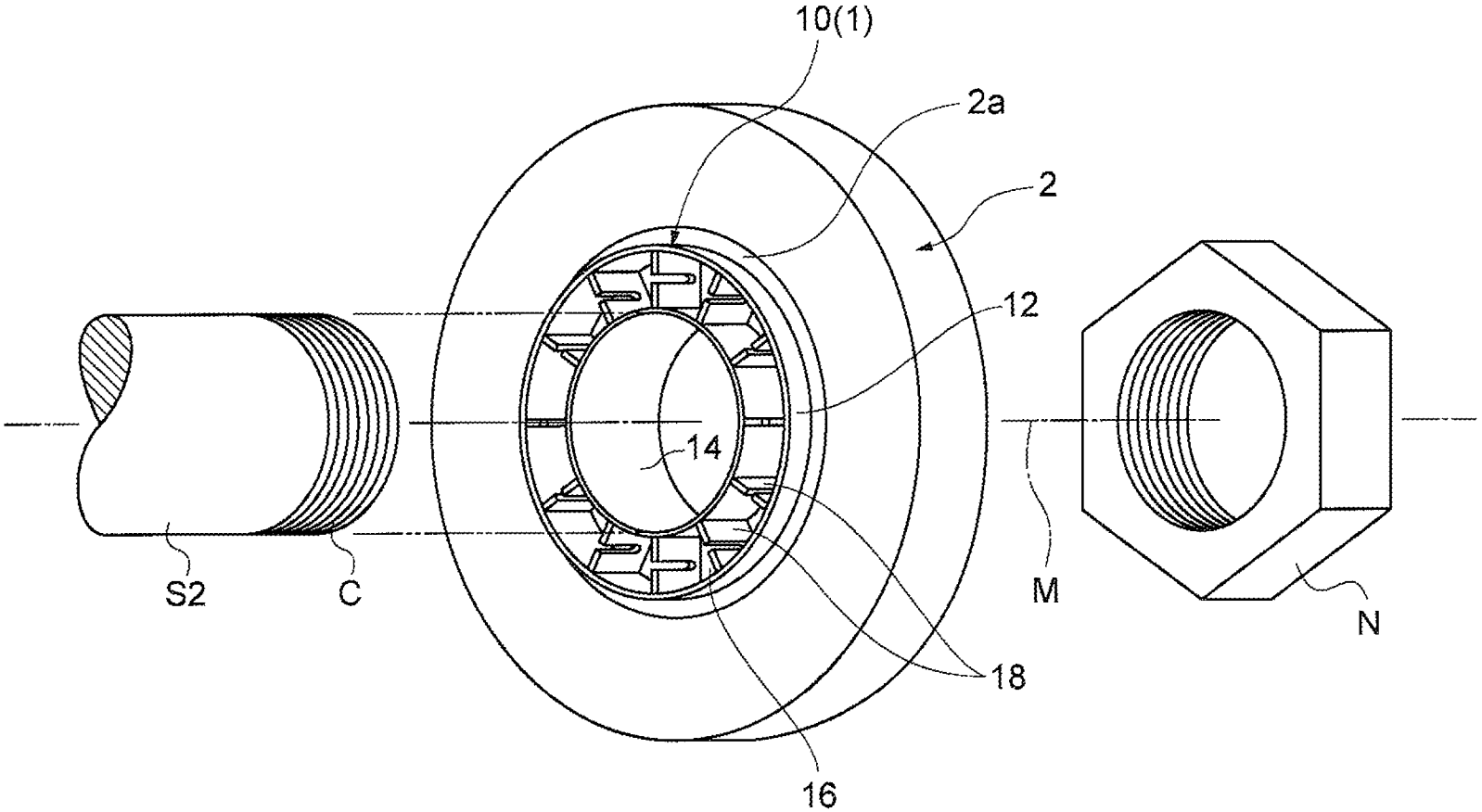
FIG. 2 is another diagram illustrating an adapter according to an embodiment inserted into a grinding wheel.
Figure 3:
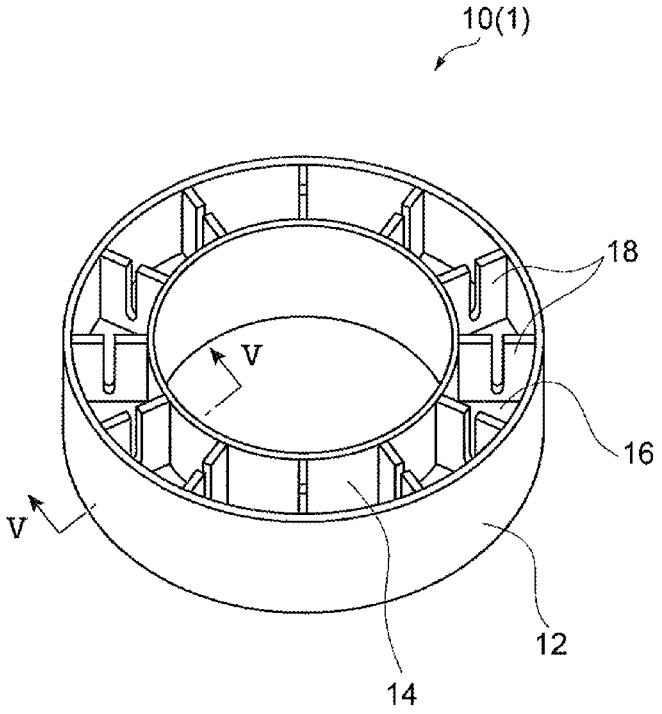
FIG. 3 is perspective view of the adapter illustrated in FIG. 1.
Figure 4:
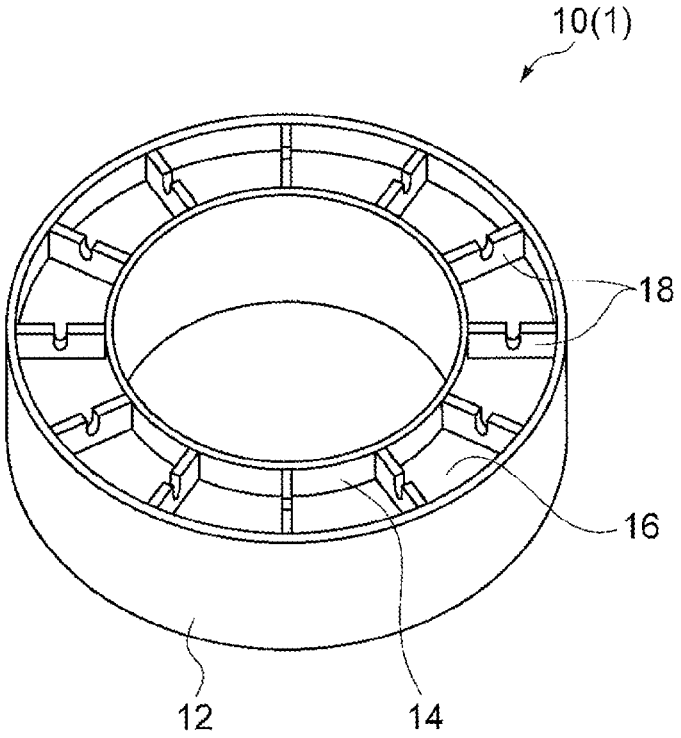
FIG. 4 is perspective view of the adapter illustrated in FIG. 1.
Figure 5:
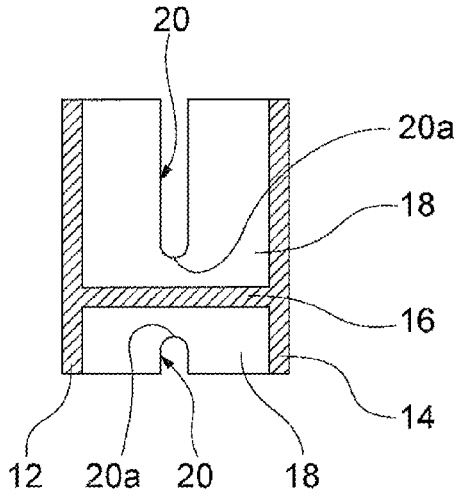
FIG. 5 is a V-V line cross-sectional view of FIG. 3.

First, an adapter 1 according to an embodiment will be described with reference to FIGS. 1 to 5. FIG. 1 is a diagram illustrating the adapter 1 inserted into a grinding wheel 2. FIG. 2 is another diagram illustrating the adapter 1 inserted into the grinding wheel 2. FIGS. 3 and 4 are perspective views of the adapter 1. FIG. 3 is a view from the end face of one side, and FIG. 4 is a view from the other end face. FIG. 5 is a V-V line cross-sectional view of FIG. 3.

As illustrated in FIG. 1, the adapter 1 is a member for fixing the grinding wheel 2 to a shaft S1. The grinding wheel 2 has a through-hole where the shaft S1 of a grinding machine is inserted, and the adapter 1 is inserted and securely fixed inside a wheel core 2*a* which forms this through-hole. The adapter 1 forms an overall ring shape to match the wheel core 2*a* and the shaft S1 and has a fixed width along an axis M of the shaft S1. Below, the direction along this axis M may also be referred to as the width direction of the adapter 1 and the grinding wheel 2.

The length in the width direction of the adapter 1 may be longer than the length of the width direction of the grinding wheel 2. In this case, a portion of the adapter 1 is exposed from the grinding wheel 2 as illustrated in FIG. 1. Even if the width of the adapter 1 is less than or equal to the width of the grinding wheel 2, the adapter 1 may be partially exposed when attached to the grinding wheel 2 as illustrated in FIG. 1.

Note that the type of grinding machine is not limited, and the adapter 1 may be used for any grinding machine that uses a shaft.

For example, as illustrated in FIG. 2, the adapter 1 may be used for a grinding machine having a shaft S2 formed having a screw thread C, and a nut N that corresponds to the screw thread C. The grinding wheel 2 has a through-hole where the shaft S2 of the grinding machine is inserted, and the adapter 1 is inserted inside the wheel core 2*a* that forms this through-hole. The grinding wheel 2 is then fixed to the shaft S2 by screwing together the nut N and the shaft S2 inserted into the through-hole of the adapter 1 and sandwiching the adapter 1 inserted into the grinding wheel 2. In the example of FIG. 2, a portion of the adapter 1 is also exposed from the grinding wheel 2.

At least one portion of a main body 10 of the adapter 1 can be inserted into the through-hole. As illustrated in FIGS. 3 and 4, the main body 10 has an outer wall 12, an inner wall 14, an annular ring part 16, and a plurality of reinforcing parts 18. Examples of material for the adapter 1 include ABS resin, nylon resin, polypropylene resin, and any of these resins with glass fiber therein, but the adapter 1 may be fabricated using materials other than these.

The outer wall 12 is a portion that contacts the wall of the through-hole of the grinding wheel 2, or in other words the wheel core 2*a*. The length in the width direction of the outer wall 12 may be longer than, the same as, or shorter than the length in the width direction of the grinding wheel 2. The external diameter of the main body 10, which is determined by the outer wall 12, may be the same as the diameter of the through-hole of the grinding wheel 2. The reason for making the exterior diameter of the main body 10 slightly larger than the diameter of the through-hole of the grinding wheel 2 is to securely fix the adapter 1 (main body 10) by the grinding wheel 2

The inner wall 14 is a portion that forms an opening corresponding to the shaft. The ability to optionally set the length of the width direction of the inner wall 14 is the same as with the outer wall 12.

In the present embodiment, the relationship between the inner diameter of the main body 10 determined by the inner wall 14 and the size of the diameter of the shaft is not limited. The inner diameter of the main body 10 determined by the inner wall 14 may be the same as the diameter of the shaft, or it may be slightly smaller than the diameter of the shaft as long as the shaft can pass through the opening. The reason for making the interior diameter of the main body 10 slightly smaller than the diameter of the shaft is to securely fix the adapter 1 (main body 10) by the shaft.

Alternatively, the inner diameter of the main body 10 determined by the inner wall 14 may be slightly larger than the diameter of the shaft as long as the adapter 1 that has gone through the shaft is not loose. The reason for making the interior diameter of the main body 10 slightly larger than the diameter of the shaft is to make the removal and installation of the shaft to the adapter 1 (main body 10) easier.

Even in such case, the grinding wheel 2 can be fixed to the shaft S2 by screwing together the nut N and the shaft S2 inserted into the through-hole of the adapter 1 and sandwiching the adapter 1 (main body 10) inserted into the grinding wheel 2.

The annular ring part 16 is a plate-shaped portion that connects the outer wall 12 and the inner wall 14 and extends along the radial direction from the outer wall 12 to the inner wall 14. In the present embodiment, the annular ring part 16 is provided in a position close to one end face side, as illustrated in FIGS. 3 to 5, and not in a middle portion in the width direction of the main body 10; however, the annular ring part 16 may be provided in a middle portion.

As illustrated in FIGS. 3 and 4, the plurality of reinforcing parts 18 are provided in a radial pattern on both sides of the annular ring part 16. Each reinforcing part 18 is provided so as to be interposed between the outer wall 12, the inner wall 14, and the annular ring part 16. In the present embodiment, the reinforcing parts 18 are substantially rectangular plates. It is most preferred that the thickness in the circumferential direction of the reinforcing parts 18 be set as desired, and thus, the reinforcing parts 18 do not need to be plate-shaped.

Various methods may be considered as an installation method of the reinforcing parts 18. Any number of reinforcing parts 18 may be set. The reinforcing parts 18 may also be provided on only one surface side of the annular ring part 16. In the present embodiment, the plurality of reinforcing parts 18 are provided so that a pair of reinforcing parts 18 interposes the annular ring part 16, but it is not necessary to arrange a reinforcing part 18 on one side back-to-back with a reinforcing part 18 on the other side. Further, the number of the reinforcing parts 18 on one side of the annular ring part 16 may differ from that on the other side.

A notch 20 is formed on each of the reinforcing parts 18. As illustrated in FIG. 5, the notch 20 extends along the width direction of the main body 10 from an area forming one end of the main body 10. A tip end 20*a* of the notch 20 is rounded (semicircular), but whether or not to round the tip end 20*a* is optional.

In the present embodiment, one reinforcing part 18 has one notch 20, but a plurality of notches may be formed on one reinforcing part. The length of the notch 20 provided on the plurality of reinforcing parts 18 may be uniform or different. Furthermore, the notch 20 need not be formed on all of the reinforcing parts 18, but may be formed on only some of the reinforcing parts 18 so that the adapter 1 as a whole contracts when inserted into the grinding wheel.

As described above, one aspect of the present invention is an adapter for fixing to a shaft a grinding wheel having a through-hole where the shaft of a grinding machine is inserted. The adapter is provided with a main body where at least a portion is inserted into the through-hole and the main body includes an outer wall that contacts a wall of the through-hole and an inner wall that forms an opening that corresponds to the shaft, and a plurality of reinforcing parts provided in predetermined intervals along a circumferential direction of the main body. Each reinforcing part extends from the inner wall to the outer wall, and a notch is formed in each reinforcing part.

With this aspect, it is possible to adjust a gap between the grinding wheel inner diameter and the shaft diameter and enable the grinding wheel to be appropriately fixed to the shaft.

Further, because a notch is formed in the reinforcing part, the reinforcing part flexes when the adapter is inserted into the through-hole of the grinding wheel and generates a restoring force after insertion such that the reinforcing part tries to return to its original form. Because a constant pressure is applied toward the wall of the through-hole from the outer wall of the adapter by the restoring force, the adapter is securely fixed inside the grinding wheel. Therefore, if the adapter is appropriately fixed to the shaft, the grinding wheel can ultimately be securely fixed to the shaft.

In another aspect of the present invention, the main body has an annular ring part that connects the outer wall and the inner wall, and a plurality of reinforcing parts may be provided on the annular ring part. In this case, the reinforcing parts are supported from three directions by the outer wall, the inner wall, and the annular ring part, and the reinforcing parts which are under stress when in use can be more reliably protected.

In another aspect of the present invention, a plurality of reinforcing parts may be provided on both sides of the annular ring part. In this case, the fixing force of the adapter relative to the grinding wheel can be increased by providing more reinforcing parts that generate a restoring force.

In another aspect of the present invention, the tip end of the notches may be rounded. In this case, the area around the tip end becomes less likely to develop cracks.

In another aspect of the present invention, the inner wall may contact the shaft. In this case, a fixed pressure is applied to the shaft from the inner wall of the adapter by the restoring force of the reinforcing parts, thereby securely fixing the adapter to the shaft. Therefore, the grinding wheel can be securely fixed to the shaft by only the adapter.

Embodiments of the present invention have been described above, but the present invention is not limited to the embodiments described above. Many variations are possible as long as there is no deviation from the spirit of the invention.

Figure 6:
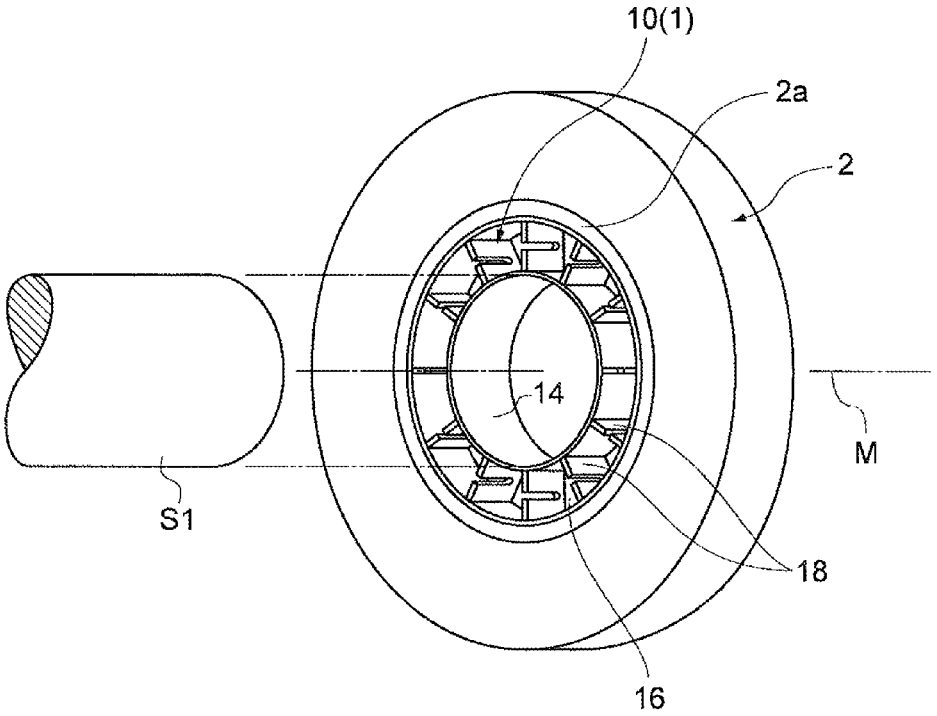
FIG. 6 is another diagram illustrating an adapter according to an embodiment inserted into a grinding wheel.

If the length in the width direction of the adapter 1 is less than or equal to the length in the width direction of the grinding wheel 2, the adapter 1 as a whole can be fit into the through-hole so that the adapter 1 does not protrude from the end of the grinding wheel as illustrated in FIG. 6. In this case, the length of the grinding wheel 2 relative to the shaft S1 can be sufficiently ensured.

In the embodiment described above, the surface of the outer wall 12 and the inner wall 14 are generally smooth, but the forms of the wall surfaces are not limited to this. The outer wall 12 and the inner wall 14 may be formed with a protruding and recessing shape. In this case, the adapter 1 is fixed to the shaft by forming a protruding and recessing shape that fits the protruding and recessing shape on the shaft or wheel core.

Figure 7:
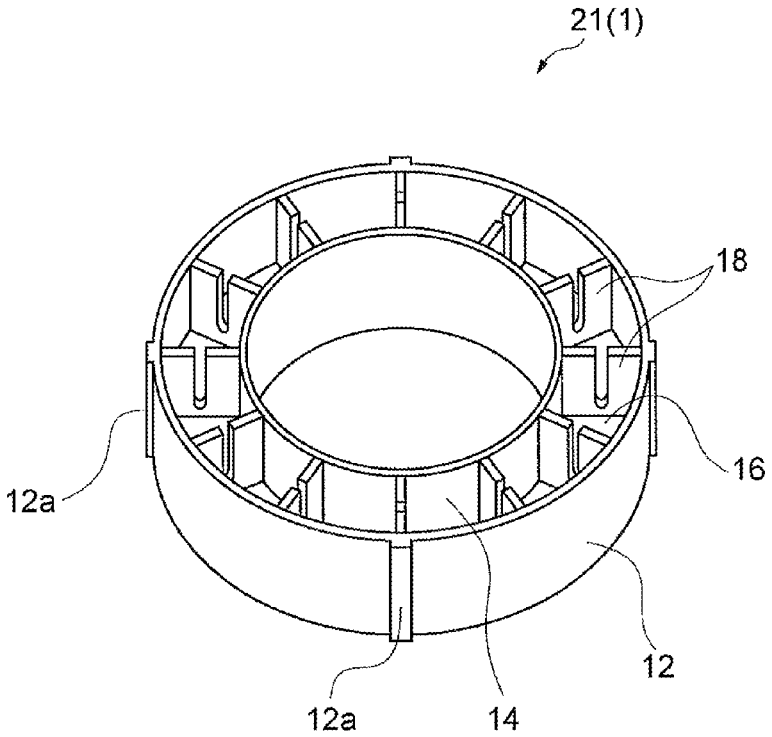
FIG. 7 is a perspective view illustrating a modified example of an adapter according to an embodiment.

For example, as illustrated in a main body 21 in FIG. 7, a protruding portion 12*a* may be formed in the width direction on the surface of the outer wall 12. In this example, the protruding portion 12*a* is formed in four places at 90 degree angles.

Figure 8:
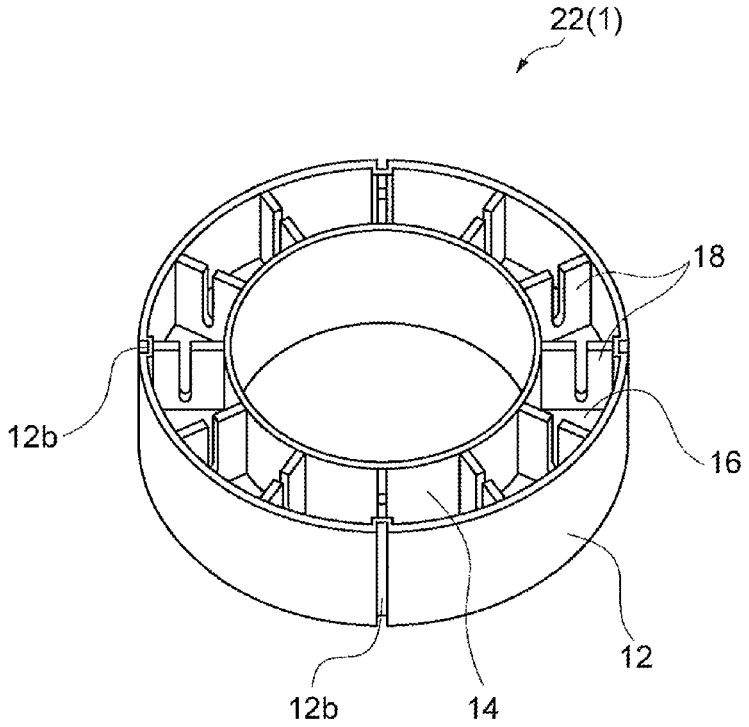
FIG. 8 is a perspective view illustrating another modified example of an adapter according to an embodiment.

Alternatively, as illustrated in the main body 22 in FIG. 8, a recessing portion 12*b* may be formed in the width direction on the surface of the outer wall 12. In this example, the recessing portion 12*b* is formed in four places at 90 degree angles.

Figure 9:
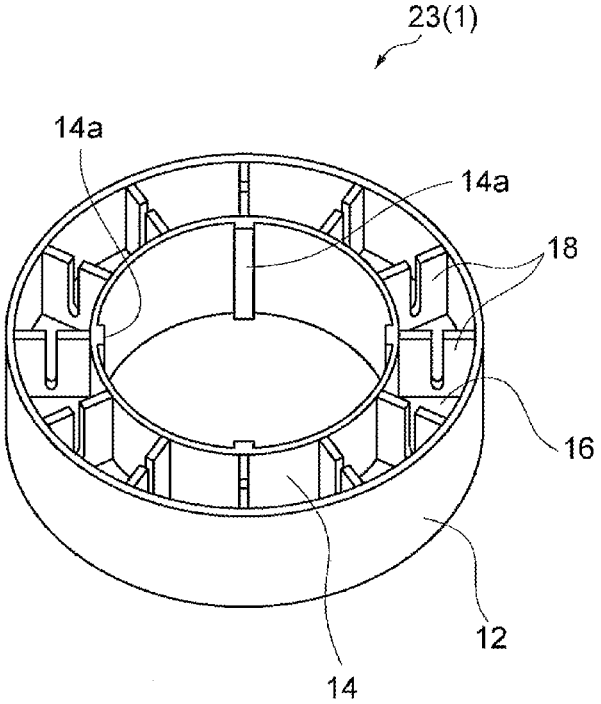
FIG. 9 is a perspective view illustrating another modified example of an adapter according to an embodiment.

Alternatively, as illustrated in the main body 23 in FIG. 9, a protruding portion 14*a* may be formed in the width direction on the surface of the inner wall 14. In this example, the protruding portion 14*a* is formed in four places at 90 degree angles.

Figure 10:
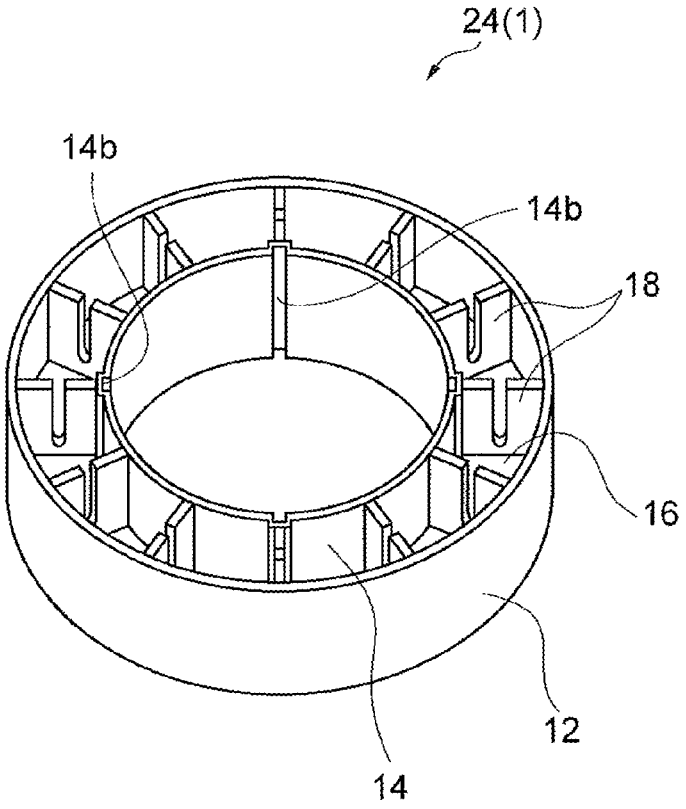
FIG. 10 is a perspective view illustrating another modified example of an adapter according to an embodiment.

Alternatively, as illustrated in the main body 24 in FIG. 10, a recessing portion 14*b* may be formed in the width direction on the surface of the inner wall 14. In this example, the recessing portion 14*b* may be formed in four places at 90 degree angles.

Figure 11:
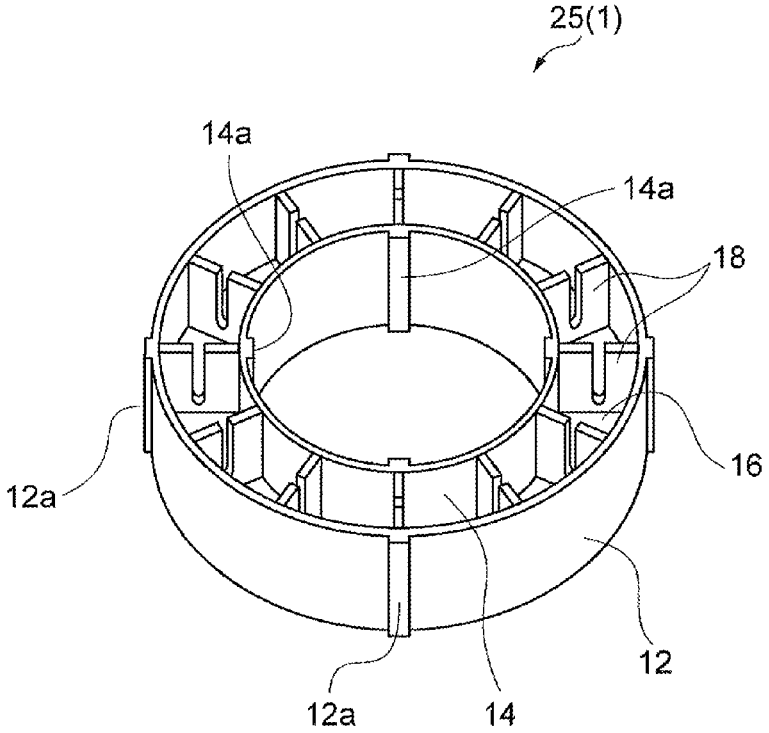
FIG. 11 is a perspective view illustrating another modified example of an adapter according to an embodiment.
Figure 12:
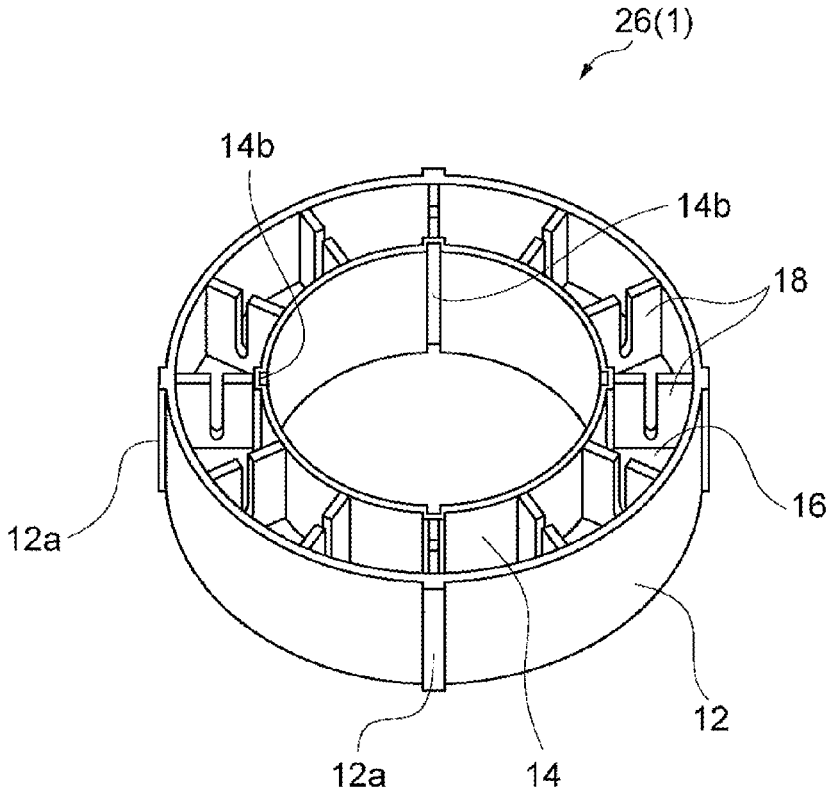
FIG. 12 is a perspective view illustrating another modified example of an adapter according to an embodiment.

The protruding portion or the recessing portion may be formed on both the outer wall 12 and the inner wall 14. A main body 25 illustrated in FIG. 11 has a protruding portion 12*a* and a protruding portion 14*a*, and a main body 26 illustrated in FIG. 12 has a protruding portion 12*a* and a recessing portion 14*b*. Naturally, the combination of the protruding and recessing shapes formed on the outer wall 12 and the inner wall 14 is not limited to these two examples.

Here, the adapter 1 illustrated in FIGS. 7 to 12 may have a protruding portion that is integrally formed with the outer wall 12 or the inner wall 14 or it may be attached to the wall surface afterwards. Moreover, the protruding portion and the recessing portion may also be formed in two locations at a predetermined interval on the wall surface of the outer wall 12 or the inner wall 14. Also, the protruding portion or the recessing portion is provided along a reinforcing part 18, but it may be positioned between two reinforcing parts 18.

Figure 13:
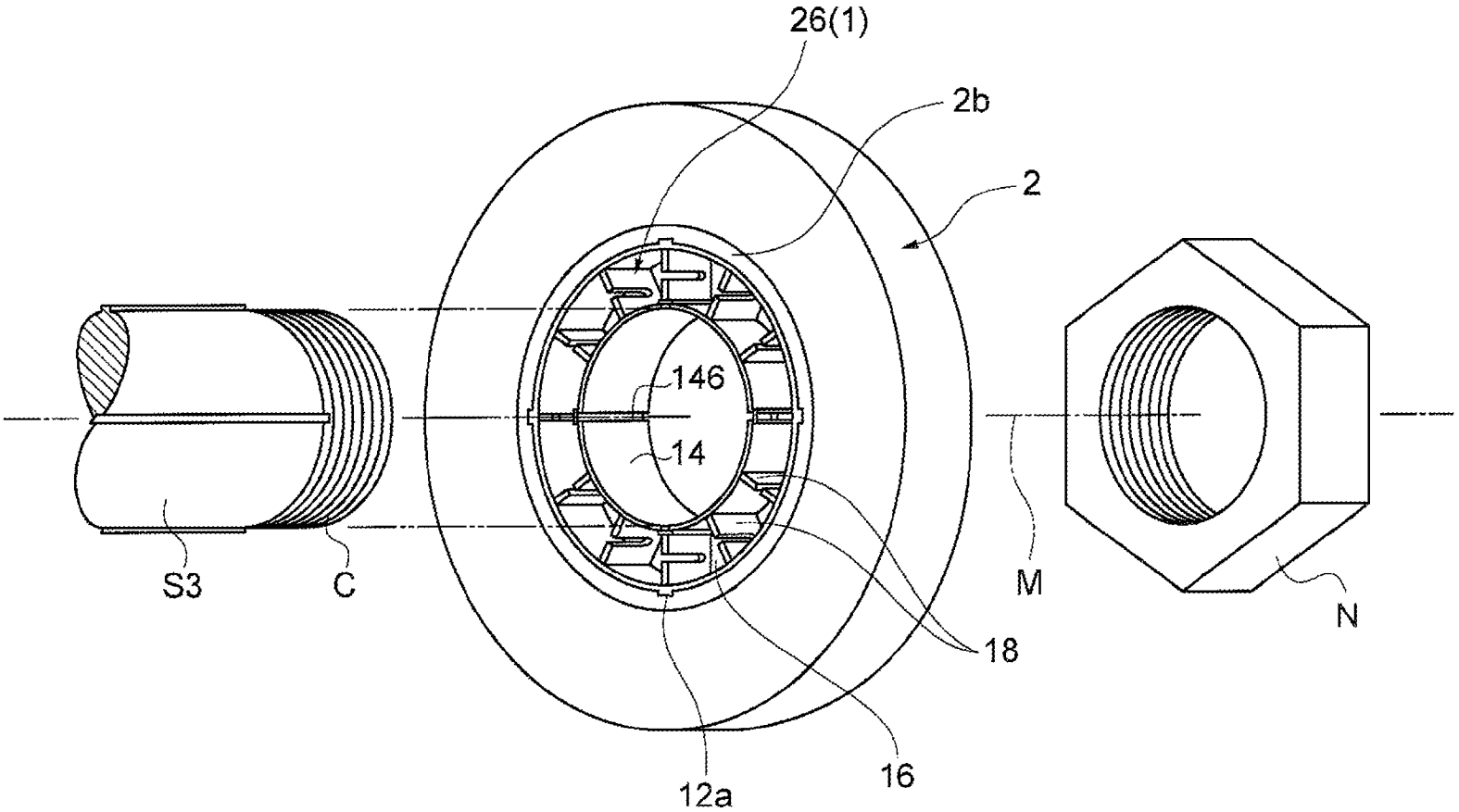
FIG. 13 is a diagram illustrating the adapter illustrated in FIG. 12 inserted into another grinding wheel.

As described above, when using the adapter 1 illustrated in FIGS. 7 to 12, a protruding and recessing shape that corresponds to the grinding wheel or the shaft must be provided. An example of using the adapter 1 having the main body 26 is illustrated in FIG. 13. In this example, a recessing portion that accommodates the protruding portion 12*a* formed on the outer wall 12 of the main body 26 is formed on the wheel core 2*b*. Moreover, a protruding portion that accommodates the recessing portion 14*b* formed on the inner wall 14 of the main body 26 is formed on the shaft S3. In FIG. 13, the length in the width direction of the adapter 1 is less than or equal to the length in the width direction of the grinding wheel 2, and the adapter 1 as a whole is inserted into the through-hole of the grinding wheel 2.

As described above, if the adapter 1 is appropriately fixed to the shaft, the grinding wheel can ultimately be securely fixed to the shaft.

Figure 14:
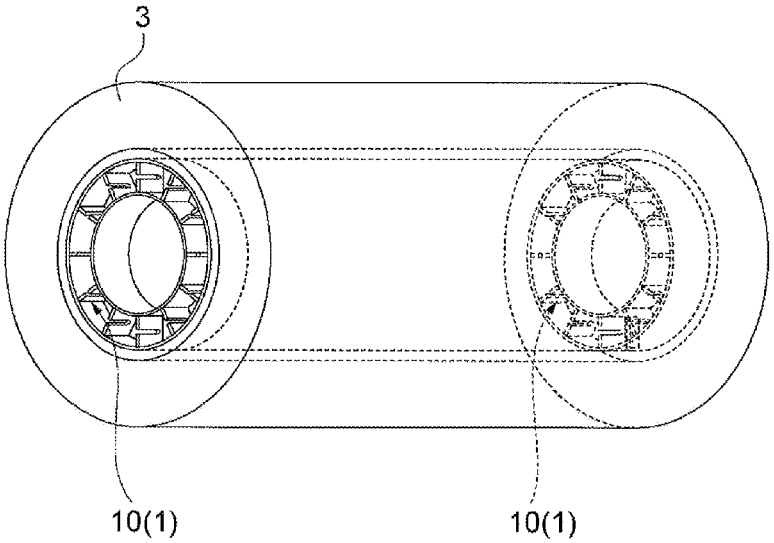
FIG. 14 is a diagram illustrating the adapter illustrated in FIG. 1 inserted into another grinding wheel.

Moreover, as illustrated in FIG. 14, the adapter 1 may be applied to a grinding wheel 3 that has a wide width. In the example of FIG. 14, the adapter 1 (main body 10) is inserted into both ends of the grinding wheel 3. Even in this modified example, the adapter 1 achieves a similar effect as that described in the above embodiment.

The invention claimed is:

1. An adapter for fixing to a shaft a grinding wheel having a through-hole where the shaft of a grinding machine is inserted, the adapter having an annular main body arranged about an axis, at least a portion of the main body configured to insert into the through-hole, the at leak one portion of the main body including both an outer wall configured to contact a wall of the through-hole and an inner wall spaced from and arranged within so as to interface with the outer wall; the inner wall configured to form an opening corresponding to the shaft; and a plurality of reinforcing parts provided in predetermined intervals along a circumferential direction of the main body, each reinforcing part extending from the inner wall to the outer wall; and a notch being formed in each reinforcing part.

2. The adapter according to claim 1, wherein the main body has an annular ring part that connects the outer wall and the inner wall, and wherein the plurality of reinforcing parts are provided on the annular ring part.

3. The adapter according to claim 2, wherein the plurality of reinforcing parts are arranged relative to the axis to be on both a first axial side of the annular ring part and on a second axial side of the annular ring part.

4. The adapter according to claim 1, wherein a tip end of the notch s rounded.

5. The adapter according to claim 1, wherein the inner wall contacts the shaft.

6. The adapter according to claim 1, wherein at least one of the inner wall and outer wall further includes one or more protruding portions configured to contact one or both of the shaft and grinding wheel.

7. The adapter according to claim 1, wherein at least one of the inner wall and the outer wall further includes one or more recessed portions configured to be recessed from contacting one or both of the shaft and grinding wheel.

8. The adapter according to claim 1, wherein the notch is configured to facilitate flexing of each of the plurality of reinforcing parts when the adapter is inserted into the through-hole and is configured to generate a restoring force after the adapter is inserted.

9. An adapter for fixing to a shaft a grinding wheel having a through-hole where the shaft of a grinding machine is inserted, the adapter comprising:

an annular first wall configured to contact wall of the through-hole;

an annular second wall spaced from and arranged within so as to interface with the first wall, the second wall configured to form an opening corresponding to the shaft; and a plurality of reinforcing parts connecting the first wall with the second wall, wherein the plurality of reinforcing parts provided at spaced apart intervals along a circumferential direction of the adapter, wherein each of the plurality of reinforcing parts having a notch formed therein, wherein the notch is configured to facilitate flexing of each of the plurality of reinforcing parts when the adapter is inserted into the through-hole and is configured to generate a restoring force after the adapter is inserted.

10. The adapter according to claim 9, wherein an annular ring part connects the outer wall and the inner wall, and wherein the plurality of reinforcing parts are provided on the annular ring part.

11. The adapter according to claim 10, wherein the plurality of reinforcing parts are arranged relative to an axis of the adapter so as to be on both a first axial side of the annular ring part and on a second axial side of the annular ring part.

12. The adapter according to claim 11, wherein the notch comprises a first notch in the first axial side of the annular ring part and a second notch in the second axial side of the annular ring part.

13. The adapter according to claim 9, wherein the second wall contacts the shaft.

14. The adapter according to claim 9, wherein at least one of the first wall and second wall further includes one or more protruding portions configured to contact one or both of the shaft and grinding wheel.

15. The adapter according to claim 9, wherein at least one of the first wall and the second wall further includes one or more recessed portions configured to be recessed from contacting one or both of the shaft and grinding wheel.

16. An adapter for fixing to a shaft a grinding wheel having a through-hole where the shaft of a grinding machine is inserted, the adapter comprising:

an annular first wall configured to contact wall of the through-hole;

an annular second wall spaced from and arranged within so as to interface with the first wall, t second wall configured to form an opening corresponding to the shaft;

a plurality of reinforcing parts connecting the first wall with the second wall, wherein the plurality of reinforcing parts provided at spaced apart intervals along a circumferential direction of the adapter, wherein each of the plurality of reinforcing parts having a notch formed therein; and an annular ring part connecting the first wall with the second wall and additionally connecting to each of the plurality of reinforcing parts.

17. The adapter according to claim 16, wherein the plurality of reinforcing parts are arranged relative to an axis of the adapter so as to be on both a first axial side of the annular ring part and on a second axial side of the annular ring part.

18. The adapter according to claim 16, wherein the notch comprises a first notch in the first axial side of the annular ring part and a second notch in the second axial side of the annular ring part.

19. The adapter according to claim 16, wherein at least one of the first wall and second wall further includes one or more protruding portions configured to contact one or both of the shaft and grinding wheel.

20. The adapter according to claim 16, wherein at least one of the first wall and the second wall further includes one or more recessed portions configured to be recessed from contacting one or both of the shaft and grinding wheel.

* * * * *